United States Patent [19]

Rhodes

[11] Patent Number: 4,944,228

[45] Date of Patent: Jul. 31, 1990

[54] CONVEYOR SYSTEM

[76] Inventor: Arthur B. Rhodes, 3347 Camp Ground Rd., Louisville, Ky. 40211

[21] Appl. No.: 337,478

[22] Filed: Apr. 13, 1989

Related U.S. Application Data

[63] Continuation-in-part of Ser. No. 270,102, Nov. 14, 1988.

[51] Int. Cl.[5] ..... B61B 10/04

[52] U.S. Cl. ..... 104/172.3; 104/172.2; 104/252

[58] Field of Search ..... 104/172.3, 172.1, 172.2, 104/238, 249, 252, 253

[56] References Cited

U.S. PATENT DOCUMENTS

| | | | |
|---|---|---|---|
| 3,295,462 | 1/1967 | Bradt | 104/172.2 |
| 3,521,568 | 7/1970 | Kato et al. | 104/172.2 |
| 3,902,576 | 9/1975 | Pitan et al. | 104/172.2 |
| 4,262,600 | 4/1981 | Carney et al. | 104/172.2 |
| 4,638,740 | 1/1987 | Rhodes | 104/172.2 |

FOREIGN PATENT DOCUMENTS

| | | | |
|---|---|---|---|
| 1456201 | 11/1976 | United Kingdom | 104/172.2 |

*Primary Examiner*—Andres Kashnikow
*Assistant Examiner*—Mark T. Le
*Attorney, Agent, or Firm*—Charles G. Lamb

[57] ABSTRACT

A conveying system for moving load carrying units, such as carts or pallets, along a predetermined conveying path includes an endless moving conveyor chain traveling in a chain guide channel defining the conveying path. The carts to be conveyed each have a depending movable conveyor chain engagement pin which is selectively movable between a conveyor chain engaged position coupling the cart to the conveyor chain so that the cart moves with the conveyor chain, and a conveyor chain disengaged position uncoupling the cart from the conveyor chain so that the cart remains stationary. The carts also include a fixed depending cart guide finger spaced from the conveyor chain engagement pin which cart guide finger also remains out of contact with the conveyor chain. Further, the conveyor system also includes a load carrying unit and a unit guide channel located over and in alignment with the chain guide channel along at least portions of the length of the chain guide channel. Both the fixed depending cart guide finger and the movable conveyor chain engagement pin, regardless of whether the conveyor chain engagement pin is in the chain engaged or disengaged position, are disposed within the load carrying unit guide channel as the cart moves along the portions of the conveying path including the load carrying unit guide channel to prevent the cart from skewing relative to the conveying path.

11 Claims, 9 Drawing Sheets

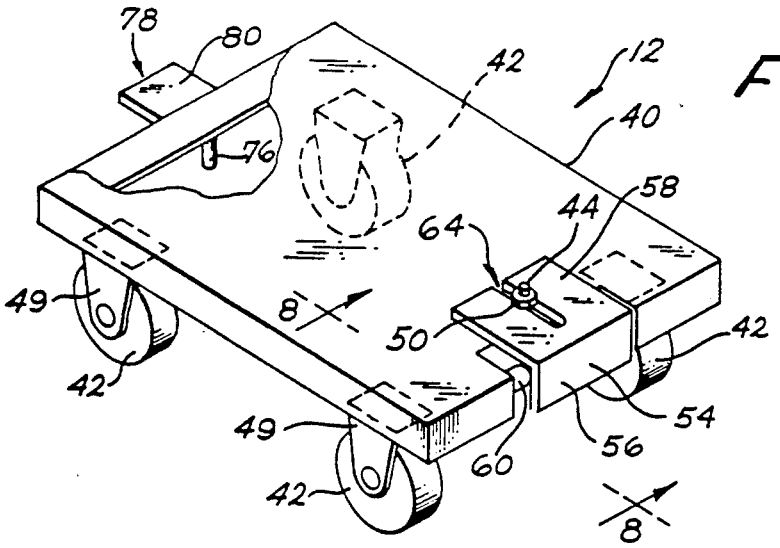
FIG. 5
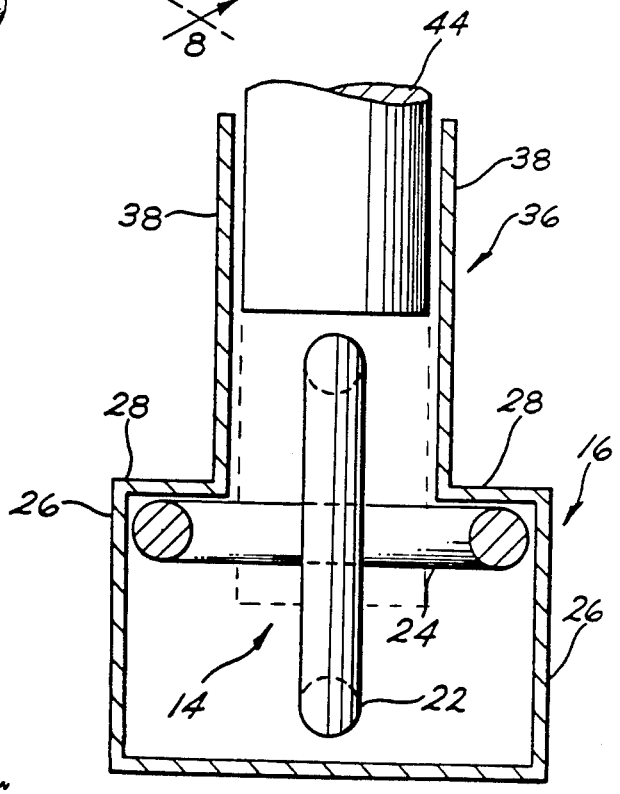
FIG. 7
FIG. 6
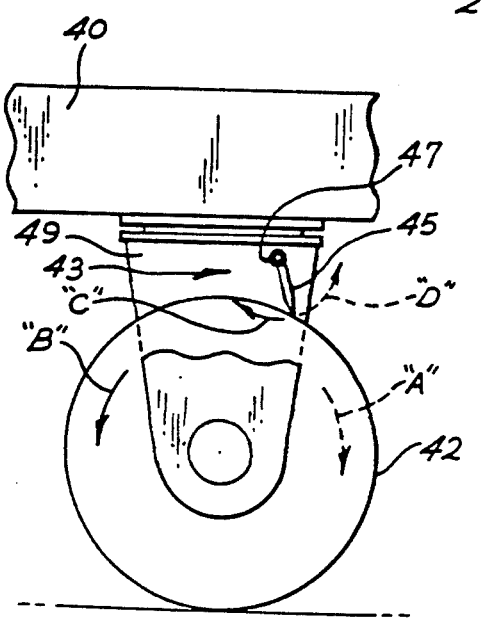

CONVEYOR SYSTEM

CROSS-REFERENCE TO RELATED PATENT APPLICATION

This is a continuation-in-part of U.S. Patent Application No. 270,102, filed Nov. 14, 1988.

BACKGROUND OF THE INVENTION

1. Field of the Invention

This invention relates to conveyor systems for moving load carrying units, such as carts or pallets, along a path defined by the conveyor system. More particularly, the invention is to a conveyor system which includes means for preventing the carts from skewing relative to the conveying path, and to a multi-level conveyor system.

2. Description of the Prior Art

Conveyor systems for transporting load carrying units, such as carts and pallets, along a path defined by the conveyor system are known. Examples of some of these type conveyor systems are shown in U.S. Pat. No. 2,918,020; U.S. Pat. No. 3,032,173; U.S. Pat. No. 3,045,610; U.S. Pat. No. 3,048,126; U.S. Pat. No. 3,194,177; U.S. Pat. No. 3,196,807; U.S. Pat. No. 3,390,641; U.S. Pat. No. 3,467,025; U.S. Pat. No. 3,618,532; U.S. Pat. No. 3,648,618; U.S. Pat. No. 3,874,302; and U.S. Pat. No. 4,438,702.

It is a problem to maintain the carts or pallets in alignment with the conveying path particularly as the carts are moved through turns therein. As the carts may skew out of alignment with the conveyor path they may interfere with equipment or operations located adjacent the conveyor path as well as making it more difficult to perform a task on a load or workpiece being carried on the cart.

SUMMARY OF THE INVENTION

The present invention provides a solution for maintaining the load carrying units in alignment with the conveying path regardless of the number and complexity of various turns or changes in direction.

More particularly, the present invention provides a conveyor system for moving load carrying units along a predetermined conveying path comprising an endless conveyor chain defining the conveying path to be traveled by the load carrying units, means for linearly moving the conveyor chain along the defined path, wall means defining a narrow open top load carrying unit guide channel along which the conveyor chain travels, the load carrying unit guide channel walls terminating above the elevation of the conveyor chain, movable pin means attached to and depending from each of the load carrying units into the load carrying unit guide channel, the movable pin means being movable between a conveyor chain engaged position in which engaged position the load carrying units are connected to the conveyor chain for movement therewith along the conveying path, and a conveyor chain disengaged position so that regardless of whether the movable pin is in the engaged or disengaged position it remains disposed within the load carrying guide channel, fixed position cart guide finger means attached to and depending from the load carrying units into the load carrying guide channel, the guide finger means being spaced from the movable pin means of the same one of the load carrying units longitudinally of the load carrying unit, the fixed position guide finger being out of engagement with the conveyor chain, and means for selectively activating the movable pin means between the conveyor chain engaged and disengaged position at predetermined locations along the conveying path.

BRIEF DESCRIPTION OF THE DRAWINGS

A better understanding of the present invention will be had upon reading the following description in conjunction with the accompanying drawings in which like parts are identified by like numbers and wherein:

FIG. 5 is a perspective view of a load carrying unit used with the conveyor systems of FIGS. 1 and 2;

FIG. 6 is an enlarged side view of a caster or wheel of the load carrying unit of FIG. 5 illustrating a novel feature of the caster;

FIG. 7 is an enlarged cross sectional view of the conveyor system similar to FIG. 4 and showing the coaction of an element of the load carrying unit with the conveyor system;

DETAILED DESCRIPTION OF THE PREFERRED EMBODIMENT

Figure 1:
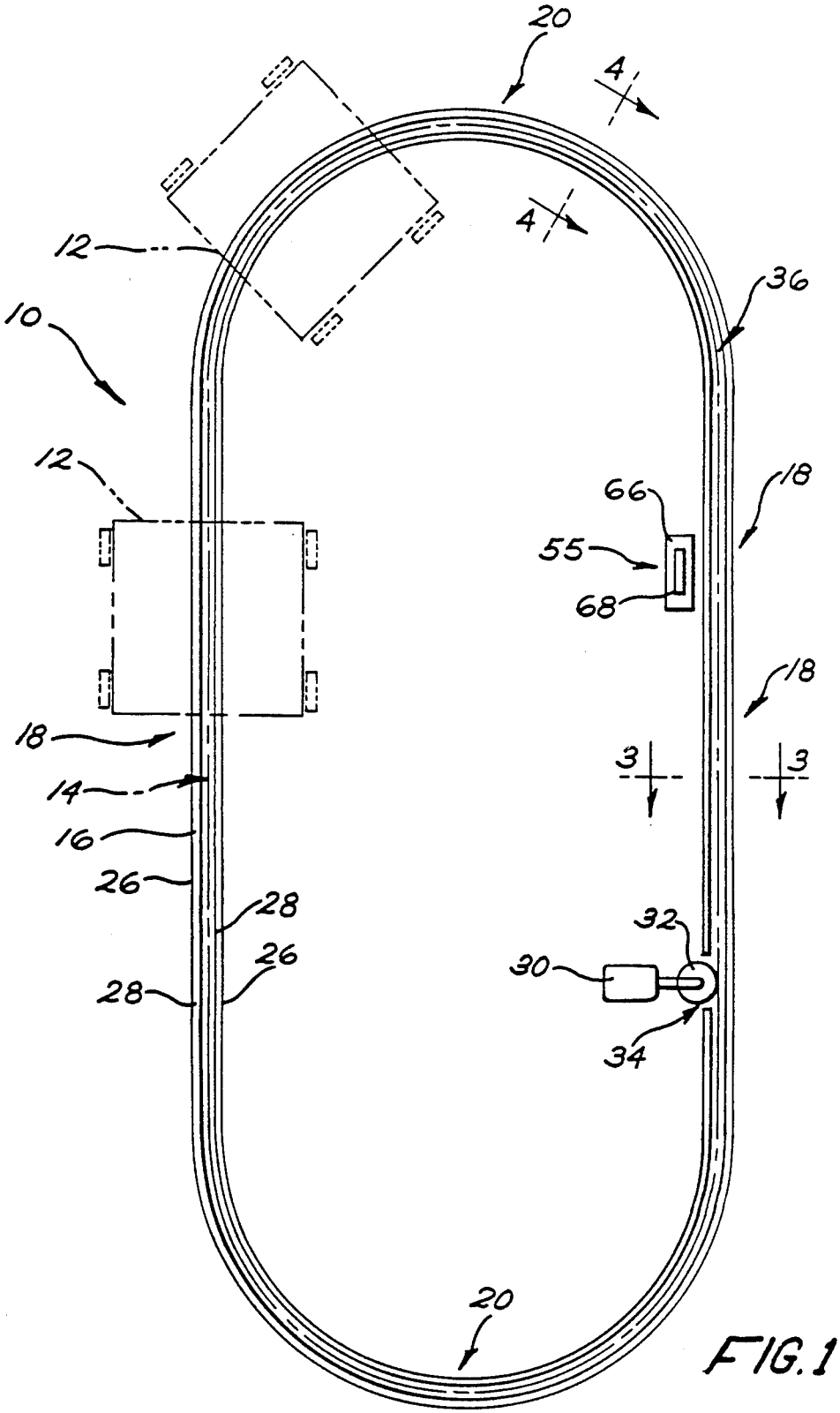
FIG. 1 is a plan view of a conveyor system embodying the present invention.

FIG. 1 is a plan view of a conveyor system, generally denoted as the numeral 10, for moving load bearing units such as wheeled carts 12, in phantom lines, along a conveying path defined by the conveyor system 10.

The conveyor system 10 comprises an endless chain 14 and a chain guide channel 16 defining the conveying path in which the endless chain 14 is laterally caged against transverse movement but which allows the chain 14 to move lineraly therealong. As shown, for the sake of illustration in FIG. 1, the chain guide channel 16 is formed with two parallel straight coextensive runs 18 and an arcuate run 20 at each end of the straight runs 18 to define a closed oval conveying path. However, it should be clearly understood that virtually any other shape can be formed by the chain guide channel 16.

Figure 3:
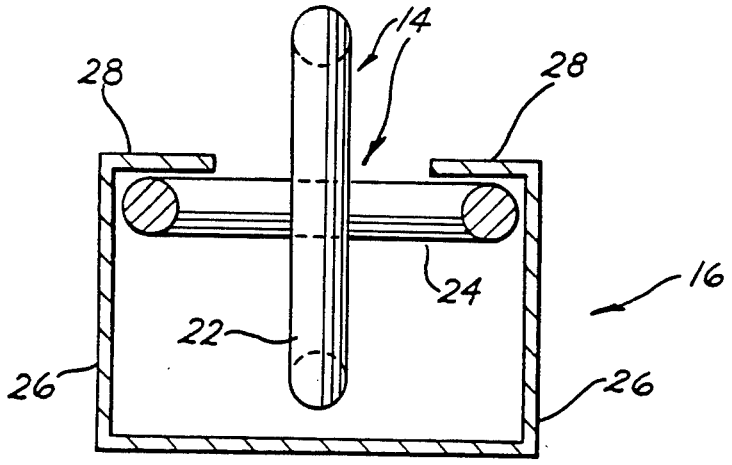
FIG. 3 is an enlarged cross sectional view of the conveyor system as seen in the direction of arrows 3—3 in FIGS. 1 and 2.
Figure 4:
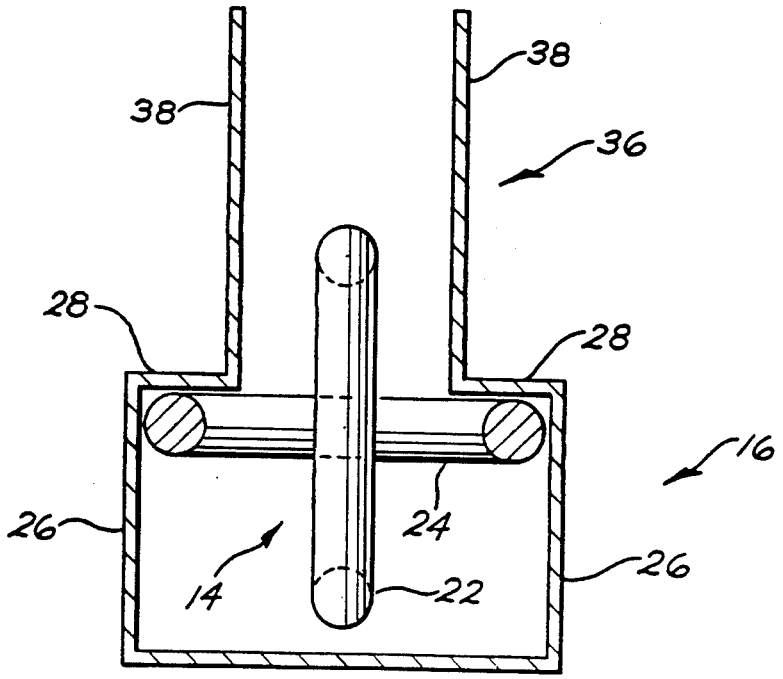
FIG. 4 is an enlarged cross sectional view of the conveyor system as seen in the direction of arrows 4—4 in FIGS. 1 and 2.

As can be best seen in FIGS. 3 and 4, the chain 14 comprises alternating vertical links 22 and horizontal links 24. The chain guide channel 16 is shown as comprising two side walls 26 spaced apart by a distance approximately equal to the width of the horizontal links 24, and top cantilevered flanges 28 which extend from the top edge of the side walls 26 toward each other over the space between the side walls 26 by a distance approximately equal to the thickness of the horizontal link 24 so that the space remaining between the free edges of the flanges 28 is approximately equal to the opening of the horizontal links 24. The chain 14 is located within the guide channel 16 with the opposite sides of the horizontal links 24 in juxtaposition with the opposite side walls 26, with the top surface of the horizontal links 24 beneath and in juxtaposition with the underside of the top flanges 28, and with the opening of the horizontal links 24 exposed to the space between the free edges of the flanges 28.

With reference once again to FIG. 1, the endless chain 14 can be linearly driven by, for example, an electric motor 30 drivingly connected to the conveyor chain 14 by a sprocket 32 affixed to the output shaft of the motor 30 and in meshing engagement with the openings of the vertical links 22 of the conveyor chain 14. Toward this end, a gap 34 can be formed in a side wall 26 of the chain guide channel 16 to receive the perimeter of the sprocket 32 for meshing engagement with the conveyor chain 14.

Now with continued reference to FIG. 1 and additional reference to FIG. 4, the chain guide channel 16 further comprises a load carrying unit guide channel 36 located over and in alignment with the chain guide channel 16. The length of load carrying unit guide channel 36 can be coextensive with the length of the chain guide channel 16, or can be located along selected portions of the length of the chain guide channel 16, for example, just the arcuate portions thereof. As shown, the load carrying unit guide channel 36 is defined by a second pair of spaced apart side walls 38 extending upwardly from the chain guide channel 16 from either side of the opening thereof between the free edges of the flanges 28 of the chain guide channel 16 such that the side walls 38 are spaced apart to either side of the endless conveyor chain 14. The spaced apart walls 38 defining the load carrying unit guide channel 36 terminate above the elevation of the conveyor chain 14.

Now with reference to FIG. 5, the load bearing unit 12 is illustrated as a cart. The cart 12 comprises a frame structure 40 and floor engaging wheels 42 rotatably attached to the frame structure 40. The frame structure 40 can be of virtually any construction and configuration to support a load to be carried and conveyed on the cart 12. A depending movable conveyor chain engagement pin 44 is attached to the cart frame 40 near the front end of the cart 12. The movable chain engagement pin 44 is movable between a lowered, conveyor chain engaged position (shown in broken lines in FIG. 7) and a raised, vertically displaced conveyor chain disengaged position (shown in solid lines in FIG. 7). In the lowered, conveyor chain engagement position the depending end of the pin 44 is received in the opening of one of the horizontal links 24 of the conveyor chain 14, and in the raised conveyor chain disengaged position the depending end of the pin 44 is spaced a distance above and out of contact with the conveyor chain 14 so that the conveyor chain 14 moves beneath the depending end of the pin 44.

Various constructions can be used to movably attach the movable pin 44 to the cart frame structure 40. As shown in FIGS. 5, 8 and 9, the movable pin 44 is axially, slidably received through a hole 46 in the frame 40 to depend vertically from the frame 40. A portion of the pin 44 also extends above the frame 40, and a keeper 50 is attached to the pin 44 proximate the upwardly extending end thereof. Movable pin activating means 52 is provided for selectively moving the pin 44 between the conveyor chain engaged position and conveyor chain disengaged position. The pin activating means 52 is shown as comprising a pivotable right angled plate 54 located at the front of the cart 12 in front of the pin 44 and a plate actuator 55. The angled plate 54 includes a first arm 56 and a second arm 58 at a right angle to the first arm 56. A pivot axle 60 is located across the plate 54 at the junction of the first arm 56 and second arm 58 and is affixed thereto so that the plate 54 will move with the axle 60 as it rotates. The opposite ends of the axle 60 extend beyond the opposite lateral sides of the plate 54 and are received in appropriate holes 62 in the frame 40 for rotational movement therein. The first arm 56 depends from the axle 60 at the front of the cart 12 and the second arm 58 extends back from the axle 60 to the location of the movable pin 44. The second arm 58 is formed with an elongated opening 64. The upwardly extending portion of the pin 44 is received in the elongated opening 64 with the keeper 50 located above the second arm 58 so that it is in abutment with the top side of the second arm 58. The conveyor engagement pin 44 is biased to the lowered conveyor chain engagement position by the force of gravity.

Figure 13:
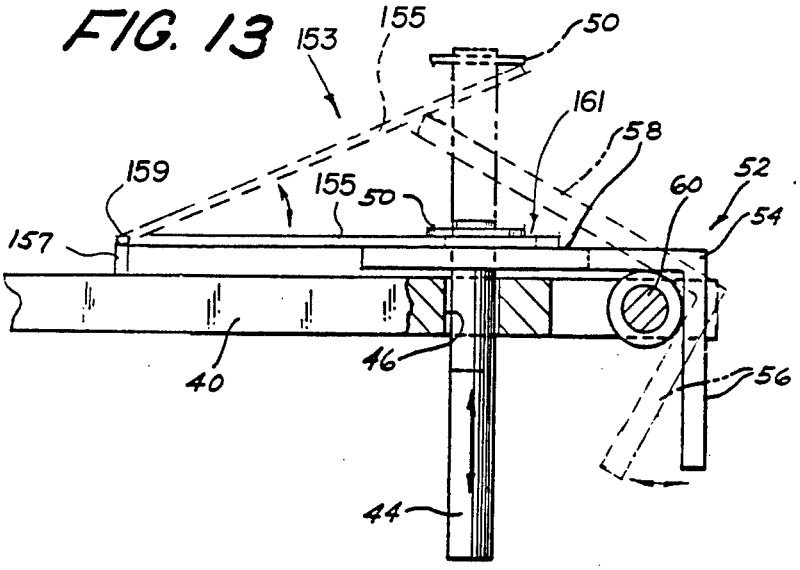
FIG. 13 is an enlarged side view of an alternative embodiment to the element of the load bearing unit of FIG. 8; and, FIG. 14 is a top view of the alternative embodiment of FIG. 13.
Figure 14:
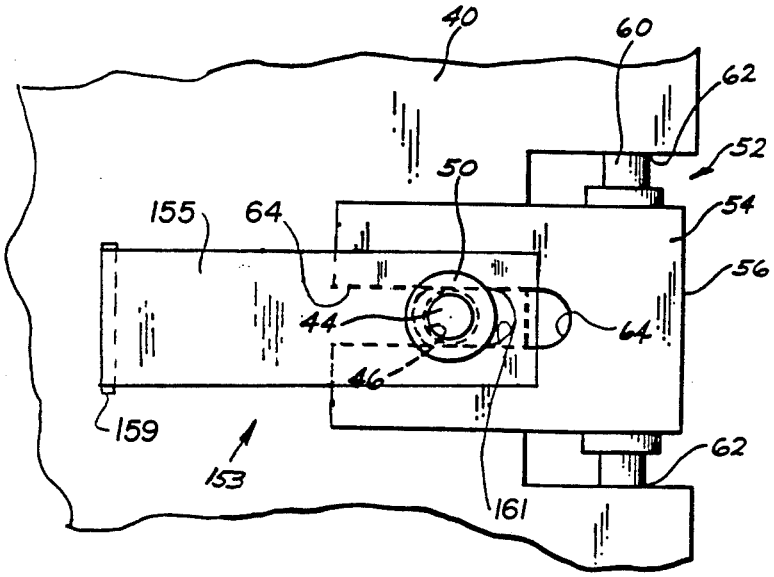

Now with reference to FIGS. 13 and 14, there is shown an alternative embodiment to the pin activating means 52 of FIGS. 5, 8 and 9, which is generally denoted in FIGS. 13 and 14 as the numeral 152. The pin activating means 152 of FIGS. 13 and 14 includes all of the features of the pin activating means of 5, 8, and 9 and, therefore, for the sake of brevity the common features are denoted by the same numerals and the description thereof will not be repeated. The pin activating means 152 further includes pin stabilizing means, generally denoted as the numeral 153 for reducing vibration or sutter of the pin 44 as it moves between the raised conveyor chain disengaged position (shown in broken lines in FIG. 13) and the lowered conveyor chain engaged position (shown in solid lines in FIG. 13) as indicated by the double headed arrow in FIG. 13. As shown the pin stabilizing means 153 includes a plate 155 which is pivotally mounted to the cart frame 40 for movement with the pin 44 as the pin 44 is caused to move by the pin activating means 52. The proximal end of the stabilizing plate 155 is pivotably attached to the top of the distal end of an upstanding mounting flange 157, and the upstanding flange 157 is attached to the cart frame 40, as, for example by welding. The pivotal juncture of the stabilizing plate 155 to the mounting flange 157 is a hinge joint 159 with its pivot axis spaced from and parallel to the pivot axis 60 of the angled plate 54 of the pin activating means 52. The stabilizing plate 155 extends from the hinge joint 159 toward the pin 44 with its longitudinal axis in longitudinal alignment with the longitudinal axis of the second arm 58 of the pin activating means 52. As can be best seen in FIG. 14, the stabilizing plate 155 is provided with an elongated slot 161 near the distal end of the stabilizing plate 155 having a minor or width dimension only slightly larger than the diameter of the pin 44 and with the major axis of the slot 161 coaxial with the longitudinal axis of the stabilizing plate 155. The elongated slot 161 receives the top end of the pin 44 between the keeper 50 and the second ar 58 of the pin activating means 52.

Figure 7A:
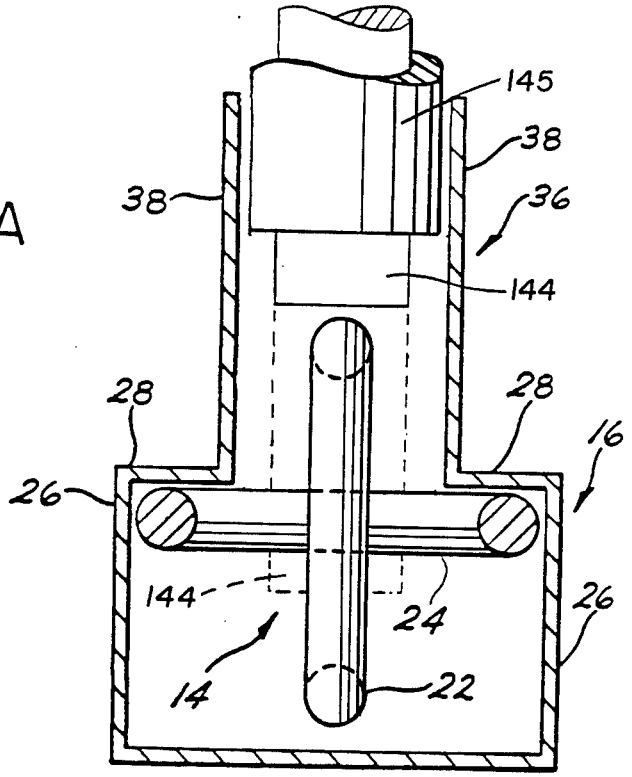
FIG. 7A is an enlarged cross sectional view of the conveyor system similar to FIG. 7 and showing the coaction of a alternative element of the load carrying unit with the conveyor system.
Figure 8A:
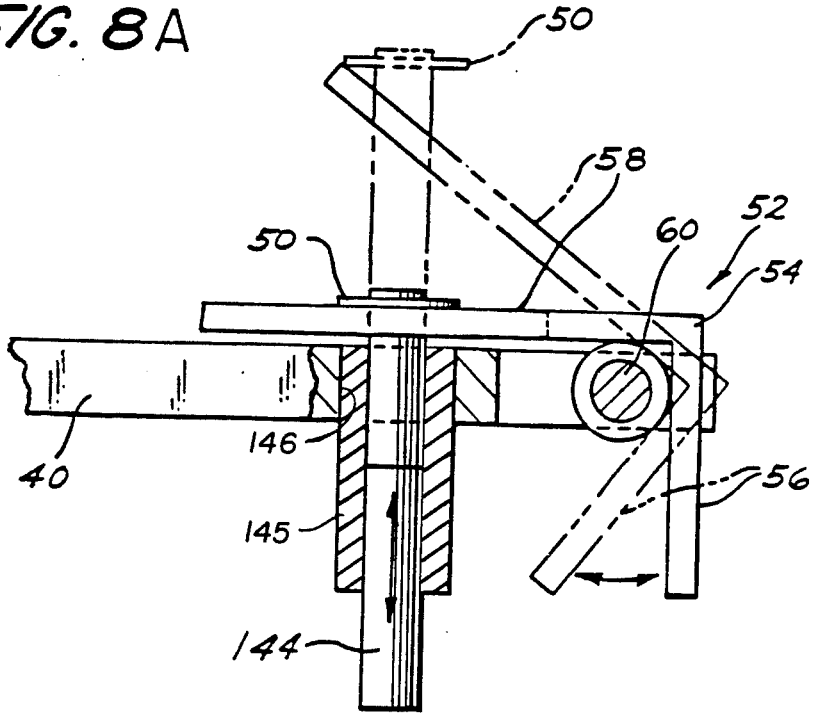
FIG. 8A is an enlarged side view of an alternative embodiment of a element of the load bearing unit.
Figure 8:
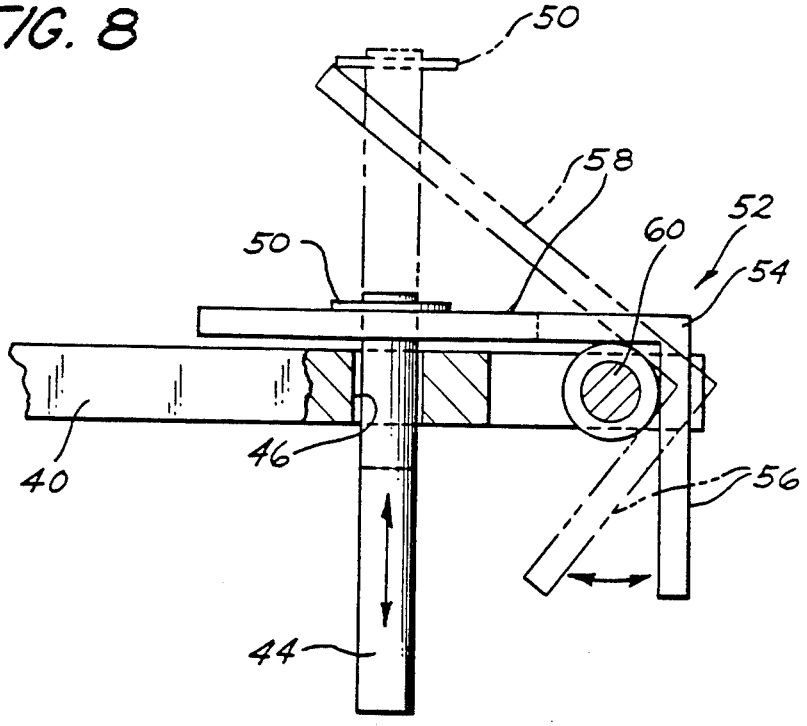
FIG. 8 is an enlarged side view of an element of the load bearing unit as seen in the direction of arrows 8—8 in FIG. 5.
Figure 9:
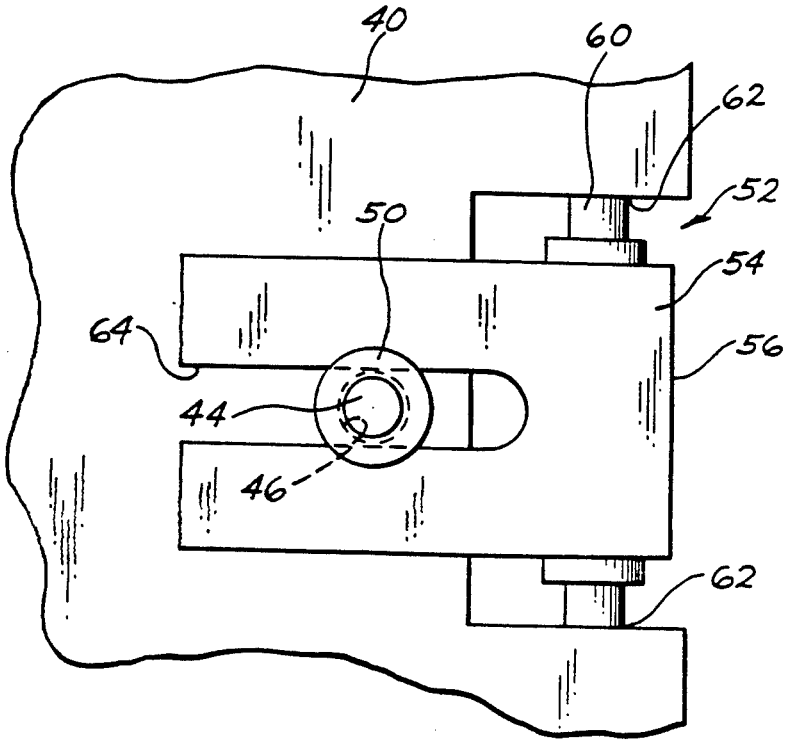
FIG. 9 is a top view of the element of FIG. 8.
Figure 11:
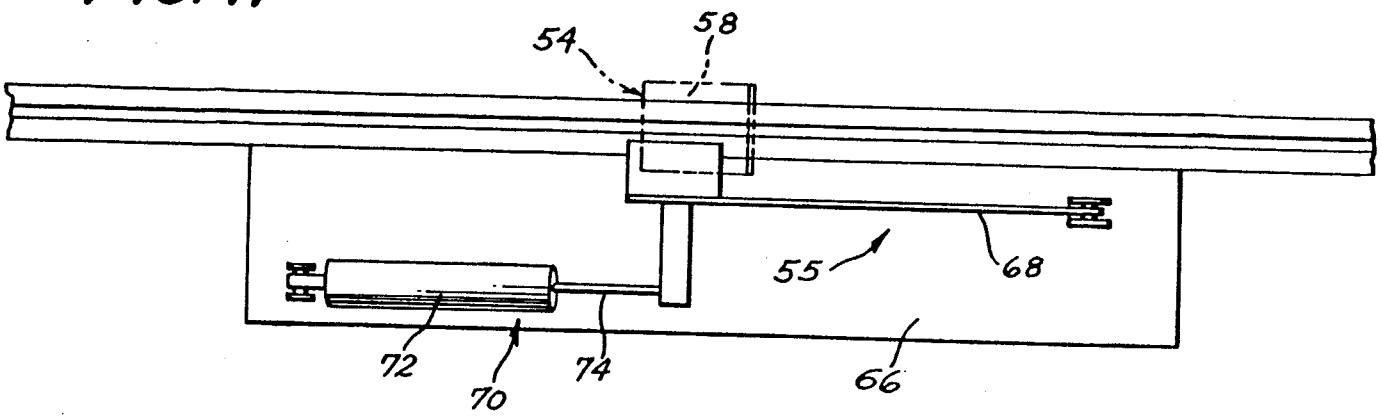
FIG. 11 is an enlarged cross sectional view of the conveyor system similar to FIG. 4 and showing the coaction of another element of the load carrying unit with the conveyor system.

With reference to FIGS. 7A and 8A, there is shown another advantageous embodiment of a depending movable conveyor chain engagement pin 144 which is similar in most respects to the pin 44 of FIGS. 7 and 8 discussed above. As with the pin 44, the pin 144 is attached to the cart frame 40 near the front end of the cart 12. The movable chain engagement pin 144 is movable between a lowered, conveyor chain engagement position (shown in broken lines in FIG. 7A) and a raised, vertically displaced conveyor chain disengaged position (shown in solid lines in FIG. 7A). In the lowered, conveyor chain engagement position the depending end of the pin 144 is received in the opening of one of the horizontal links 24 of the conveyor chain 14, and in the raised conveyor chain disengaged position the depending end of the pin 144 is spaced a distance above and out of contact with the conveyor chain 14 so that the conveyor chain 14 moves beneath the depending end of the pin 44. The movable pin 144 is concentrically slidably received in a sleeve 145. The sleeve 145 is received through a hole 146 in the frame 40 to depend vertically from the frame 40 into the guide channel 36 and is fixedly attached to the frame 40 by, for example, welding. The sleeve 145 terminates above the conveyor chain 14 and has a diameter only slightly smaller than the width of the load carrying unit guide channel 36 between the spaced apart walls 38 thereof to provide a clearance between the sleeve 145 and guide channel walls 38 so that the sleeve 145 can move linearly in the guide channel 36 as the load bearing units 12 move with the conveyor chain 14. A portion of the pin 144 depends from the bottom end of the sleeve 145 so that the depending end of the pin 144 can be received in an opening of one of the horizontal links 24 of the conveyor chain 14 as discussed above. A portion of the pin 144 also extends above the frame 40, and a keeper 50 is attached to the pin 144 proximate the upward extending end thereof. The movable pin actuating means 52 discussed above in regard to the pin 44 of FIGS. 8 and 9 is provided for selectively moving the pin 144 in the sleeve 145 between the conveyor chain engaged position and conveyor chain disengaged position in the same manner as previously described in regard to the pin 44 and, therefore the description thereof will not be repeated for the sake of brevity. The sleeve 145 being only slightly less in diameter than the width of the guide channel 36 coacts with the channel walls 38 when the pin 144 is in the raised conveyor chain disengaged position to hold the raised pin 144 laterally centered in the channel 36 so that it is in alignment with the conveyor chain 14. Thus, when the pin 144 is lowered to the conveyor chain engaged position it is in proper alignment with the chain 14 to immediately properly engage the chain 14.

Figure 12:
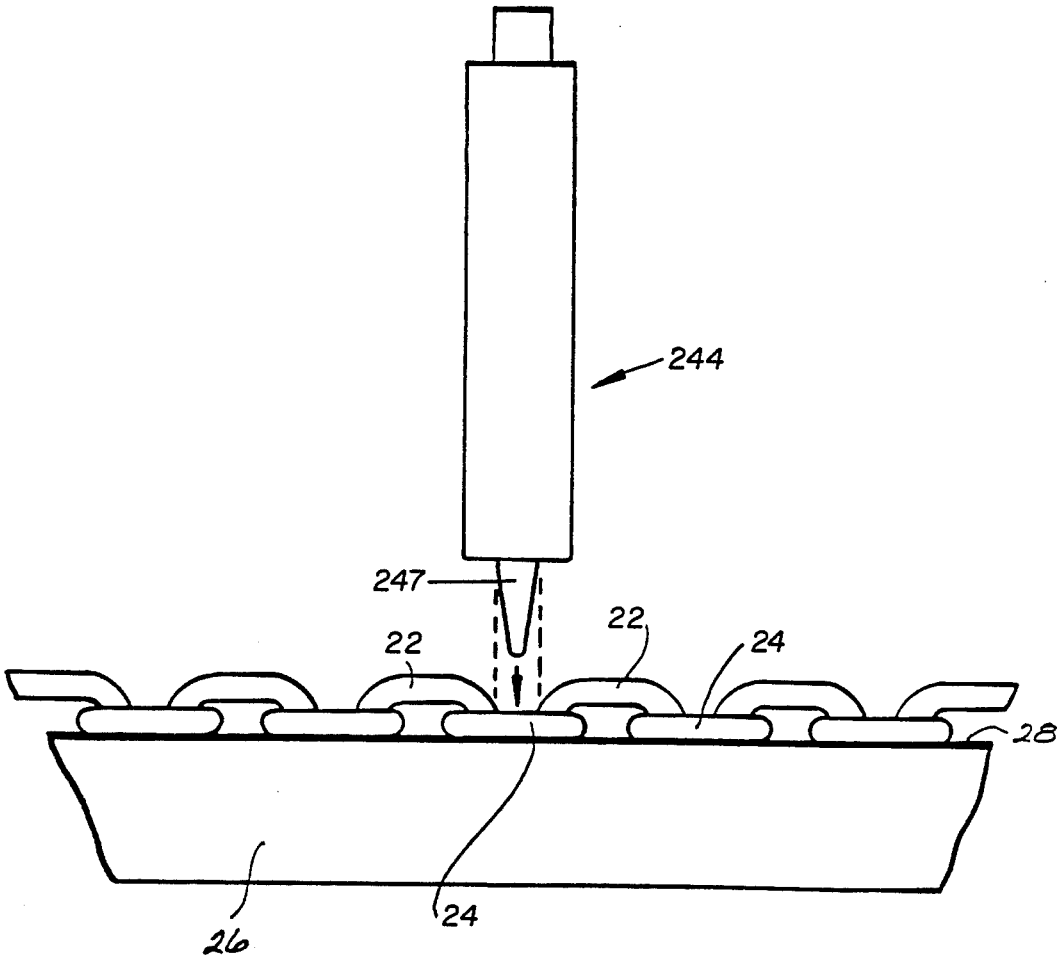
FIG. 12 is an enlarged side view of an alternative embodiment of an element of the load bearing unit of FIG. 8.

Now with reference to FIG. 12, there is shown an alternative embodiment to the pin 44 of FIGS. 7 and 8 which generally denoted as the numeral 244 in FIG. 12. The depending end 247 of the pin 244 is tapered. The taper of the depending pin end 247 further provides for the smooth insertion of the depending end 247 into the opening of one of the horizontal links 24 of the conveyor chain 14 in the event the pin 244 is not in perfect alignment with the opening of the horizontal chain link 24. The taper of the depending pin end 247 functions to guide the depending pin end 247 into the misaligned opening of the horizontal chain link 24. Even further, the taper of the depending end 247 of the pin 244 functions to provide the smooth removal or release of the depending end 247 from the opening of the horizontal chain link 24. It is speculated that this is due to the fact that the horizontal force vector exerted by the horizontal chain link 24 against the pin end 247 is not perpendicular to the taper of the depending pin end 247 and, therefore, the component of this horizontal force vector which is perpendicular to the taper of the pin end 247 is less than the horizontal force vector. This results in a frictional force between the depending tapered pin end 247 and chain link 24 which is less than the frictional force between the straight sided pin 44, 144 and chain link 24. The frictional force between the pin 44, 144, 244 and chain link 24 must be overcome when raising the pin 44, 144, 244 to its disengaged position. Therefore, the less the friction force the smoother and easier it is to remove the pin from the chain link 24. In practice, it has been determined that a taper of from 3 to 15 degrees works well to provide a firm enough coaction between the depending pin end 247 and the chain link 24 required for the chain to pull the load bearing units 12 and provide for the smooth insertion and removal of the depending pin end 247 into and from the chain link 24. It should be noted that the wall of the pin 244 above the tapered end 247 has a diameter slightly smaller than the width of the load carrying unit guide channel 36 between the spaced apart walls 38 thereof to provide a small clearance between the wall of the pin 244 and the guide channel walls 28.

Figure 10:
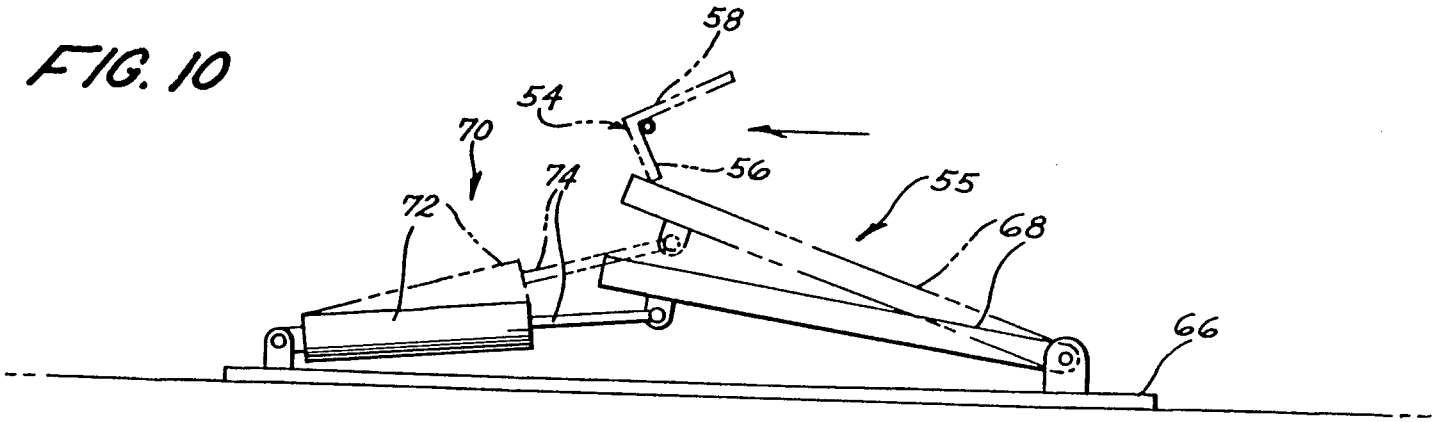
FIG. 10 is a side view of another element used with the conveyor systems of FIGS. 1 and 2.

With reference to FIGS. 1 and 10, the plate actuator 55 of the pin activating mean 52 is located next to the conveyor chain 14 at any selected location along the conveying path at which it is desired to stop the movement of the carts 12 along the conveyor path. The plate actuator 55 is shown as including a base 66 overlaying the floor next to the conveyor chain 14, a movable arm 68 attached to the base 66, and an arm actuator 70. The movable arm 68 is pivotably attached at one of its ends to the base 66 for pivotable movement in a vertical plane parallel to the conveyor chain 14 section adjacent thereto. The arm actuator 70 is shown as a fluid operated cylinder device having its piston cylinder 72 pivotably mounted to the base 66 and the distal end of its operating rod 74 pivotably attached to the movable arm 68 between the pivoted end and free end of the movable arm 68. The fluid operated cylinder device 72 can be selectively operated to retract its operating rod 74 to pivot the movable arm 68 to a lowered position beneath the depending end of the first arm 56 of the angled plate 54 of the pin moving means 52 so it will not contact the right angled plate 54, and to extend its operating rod 74 to pivot the movable arm 68 to a raised position projecting above the elevation of the depending end of the first arm 56 of the angled plate 54 of the pin moving means 52 so it will contact the right angled plate 54. When the movable ar 68 is in the raised position (shown in broken lines in FIG. 10) it contacts the depending first arm 56 of the right angled plate 54 causing the plate 54 to pivot on the axle 60. The second arm 58 is thusly moved upwardly in a arcuate motion centered on the axle 60 raising or lifting the pin 44, 144 by the keeper 50 to the vertically displaced conveyor chain disengaged position as shown in broken lines in FIGS. 8 and 8A. When the movable arm 68 is in the lowered position (shown in solid lines in FIG. 10) it does not contact the depending first ar 56 of the right angled plate 54 thus allowing the pin 44, 144 to remain in or drop vertically back to the lowered conveyor chain engaged position as shown in solid lines in FIGS. 8 and 8A.

With reference to FIGS. 13 and 14, the pin activating means 52 works as described above. In addition, the stabilizing plate 155 is also caused to pivot about its pivot axis or hinge joint 159 by the pin 44 as it is moved by the pin activating means 52. As the stabilizing plate 155 moves, with the pin 44, the elongated slot 161 provides a longitudinal clearance so that the pin 44 will move relative to the stabilzing plate 155 along the major axis of the slot 161. The lateral side edges of the elongated slot 161 cage the pin 44 and minimizing horizontal movement or otherwise assists in the alignment of the pin 44 as it moves in and out of the horizontal links 24 of the conveyor chain 14.

With reference to FIG. 5, the cart 12 also includes a pin activating device 78 affixed to the rear end of the cart frame 40 for moving the movable conveyor chain engaging pin 44 of a following cart 12 to the raised conveyor chain disengaged position in the event that a first or leading cart 12 has been disengaged from the conveyor chain 14, and is therefore stationary, and the second or following cart 12 impacts the rear end of the first cart 12. The pin activating device 78 is shown as a generally horizontal finger 80 projecting generally horizontally rearwardly from the cart frame 40 at the elevation of the pin activating means 52. As the second or following cart 12 approaches a first or leading cart 12, which is stationary, the horizontal finger 80 projecting from the rear end of the stationary cart 12 contacts the depending arm 56 of the plate 54 of the pin activating means 52 of the second or following cart 12, thusly, lifting the movable conveyor chain engaging pin 44 of the second or following cart 12 to the vertically displaced conveyor chain disengaged position thereby also disengaging the second cart 12 from the moving conveyor chain 14 so that it will also stop.

Now with reference to FIG. 6, there is shown an anti-backup device or brake 43 which prevents a stationary cart 12 from backing-up or moving in a direction opposite to the direction of movement of the conveyor chain 14 when its conveyor change engaging pin 44 is in the conveyor chain disengaged position. As illustrated, the anti-backup device 43 includes a pivotal wheel engagement arm 45 which is pivotally attached at its proximal end to a pivot pin 47. The pivot pin 47 can be attached to a wheel mounting bracket 49 which interconnects the wheel 42 to the cart frame 40. The anti-backup device 43 is positioned relative to the wheel 42 so that when the cart 12 is moving with the conveyor chain 14 in a forward direction, and therefore with the wheel 42 rotating in the forward direction shown as clockwise and indicated by the broken arrow "A" in FIG. 6, the distal end of the brake arm 45 rides on the periphery of the wheel 42 and does not interfer with the rotation of the wheel 42. However, if the cart 12 were to begin to move in a reverse direction or backup, and therefore with the wheel 42 rotating in the reverse direction shown as counter-clockwise and indicated by the solid arrow "B" in FIG. 6, the frictional contact of the distal end of the brake ar 45 and wheel 42 causes the arm 45 to pivot in the direction of movement of the wheel 45 (indicated by the solid arrow "C") causing the distal end of the brake arm 45 to be forced against the periphery of the wheel 42 increasing the frictional force between the distal end and the wheel 42 thusly preventing rotation of the wheel 42. As the cart 12 is caused to move again in a forward direction, the forward movement of the wheel 42 causes the arm 45 to pivot in the direction of rotation of the wheel (indicated by the broken arrow "D") relieving the frictional force of the distal end of the arm 45 against the periphery of the wheel 42 thereby allowing the wheel 42 to rotate in the forward direction.

With reference to FIGS. 5 and 7, the cart 12 also includes a fixed position cart guide finger 76 depending from the cart frame 40. The cart guide finger 76 is spaced apart from the movable conveyor chain engaging pin 44 longitudinally of the cart 12. As shown, the cart guide finger 76 is located near the rear end of the cart 12. The guide finger 76 depends a predetermined distance such that its top end remains spaced above the conveyor chain 14.

Now, with reference to FIG. 7, it can be seen that when the cart 12 is traveling over the length of the conveying path having the load carrying unit guide channel 36 that the movable conveyor chain engaging pin 44 remains disposed within the guide channel 36 regardless of whether the movable pin 44 is in the lowered conveyor chain engaged position or the raised conveyor chain disengaged position. The fixed position cart guide finger 76 is of a sufficient length to also be disposed within the guide channel 36.

With reference to FIG. 7A, it can be seen that when the cart 12 is traveling over that length of the conveying path having the load carrying unit guide channel 36 that the sleeve 145 depending from the cart frame 40 is disposed within the guide channel 36 and coacts with the side walls 38 of the channel 36 to maintain or hold the raised pen 144 laterally centered directly over the conveyor chain 14 and more particularly laterally centered relative to the opening of the horizontal links 24 of the conveyor chain 14 so that when the pin 144 is lowered to the conveyor chain engaged position it will be in lateral alignment with an opening of the horizontal chain links 24.

Figure 2:
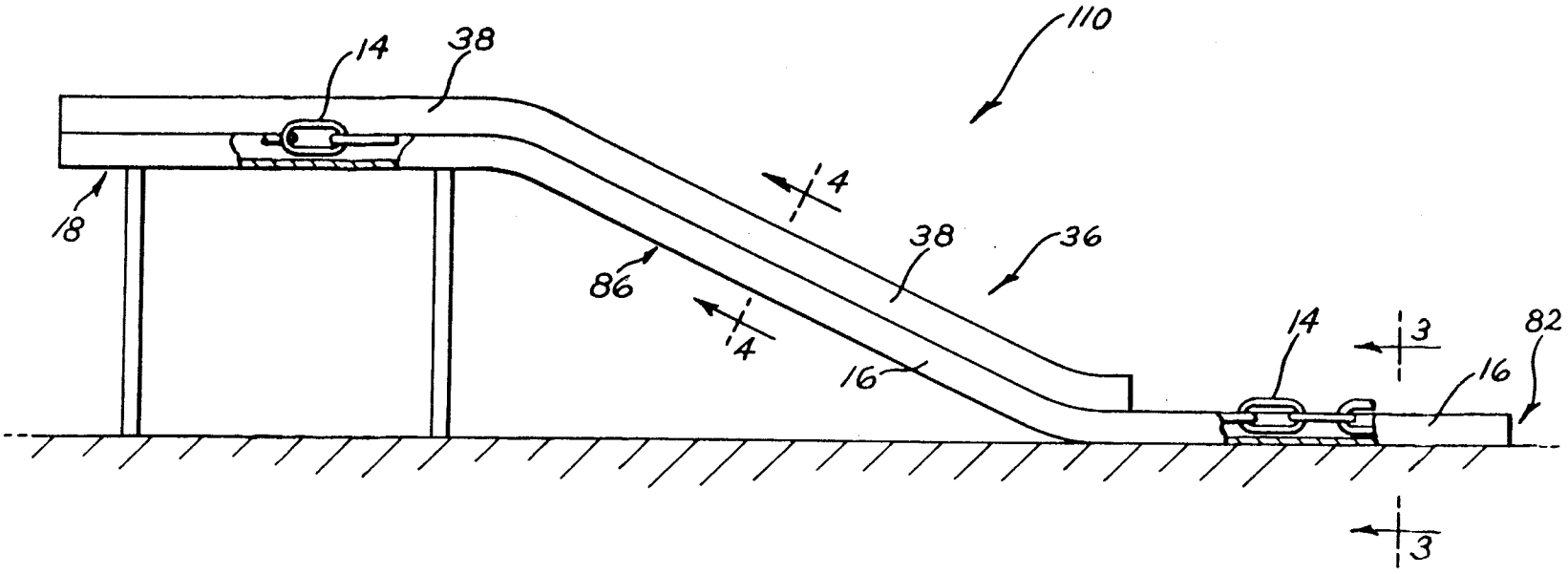
FIG. 2 is an elevational view of another conveyor system embodying the present invention.

FIG. 2 illustrates a conveyor system 110 which includes all of the novel features of the conveyor system 10 of FIG. 1 and which are identified by the same numbers in FIG. 2. Therefore, for the sake of brevity, the description of the common features will not be repeated. The conveyor system 110 includes the conveyor chain 14 traveling in the conveyor chain guide channel 16 configured to form a multi-level conveying path. For the sake of simplicity, the multi-level conveyor system 110 is shown as including a first or lower chain guide channel run 82, a second or upper chain guide channel run 84, and a slanted chain guide channel run 86 extending between the lower run 82 and upper run 84 across the transition between the different conveying levels of the lower chain guide channel run 82 and the upper chain guide channel run 84. The endless conveyor chain 14 travels in the lower chain guide channel run 82, the slanted chain guide channel run 86, and the upper chain guide channel run 84. As shown in FIG. 2, the load carrying unit guide channel 36 extends along the slanted chain guide channel run 86 and at least a portion of the length of the upper chain guide channel run 82, although it should be understood that the load carrying unit guide channel 36 can extend along the lower chain guide channel run 82 and the upper chain guide channel run 84, or any portion thereof, as well.

In operation of the conveyor system 10 and 110, the load carrying unit guide channel 36 functions to prevent the load carrying cart 12 from skewing out of alignment with the conveying path as it moves therealong with the conveyor chain 14, particularly as the cart 12 moves along the arcuate lengths of the conveyor path. The function is accomplished by the coaction of the conveyor chain engaging pin 44 and the side walls 38 of the load carrying unit guide channel 36, and the coaction of the fixed position depending cart guide finger 76 and the side walls 38 of the load carrying unit guide channel 36. The conveyor chain engaging pin 44 and the fixed depending cart guide finger 76 being spaced apart longitudinally of the cart 12 keep the cart 12 tracking with the conveyor chain 14 even as the conveyor chain 14 follows the various curves, bends and changes in elevation of the conveyor path. In addition, because the movable conveyor chain engaging pin 44 remains disposed within the load carrying unit guide channel 36 even when in the raised conveyor chain disengaged position, when a following cart 12 contacts the rear end of a stationary leading cart 12, the coaction of the raised conveyor chain engaging pin 44 of the loading cart 12 and the side walls 38 of the load carrying unit guide channel 36 prevents the stationary leading cart 12 from being jarred out of alignment with the conveyor path.

The foregoing detailed description is given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A load carrying unit for selected movement along a conveying path defined by an endless conveyor chain, comprising:

a frame structure;

floor engaging wheels rotatably attached to the frame structure;

a depending movable conveyor chain engagement pin attached to the frame structure near the front end of the frame structure movable between a lowered chain engaged position whereat the depending end of the pin engages the conveyor chain and a raised, chain disengaged position whereat the depending end of the pin is spaced above and out of contact with the conveyor chain;

pin moving means structurally associated with the pin and mounted to the front end of the frame structure for pivotable movement about an axis perpendicular to the longitudinal axis of the pin to move the pin between the lower chain engaged position and raised chain disengaged position; and, pin stabilizing means comprising a pin stabilizing plate, an upstanding mounting flange attached to the frame structure, hinge means interconnecting the top end of the mounting flange and one end of the stabilizing plate with its pivot axis spaced from and parallel to the pivot axis of the pin moving means, the stabilizing plate extending from the hinge means to the conveyor chain engagement pin, means defining a slot at the distal end of the stabilizing plate having a minor dimension slightly larger than the diameter of the conveyor chain engagement pin and with a major dimension coaxial with the longitudinal axis of the stabilizing plate receiving the top end of the conveyor chain engagement pin, and a keeper affixed to the top end of the conveyor chain engagement pin above the distal end of the stabilizing plate.

2. A load carrying unit for selected movement along a conveyor path defined by an endless conveyor chain, comprising:

a frame structure;

floor engaging wheels rotatably attached to the frame structure;

a depending movable conveyor chain engagement pin attached to the frame structure near the front end of the frame structure movable between a lowered chain engaged position whereat the depending end of the pin engages the conveyor chain and a raised, chain disengaging position whereat the depending end of the pin is spaced above and out of contact with the conveyor chain;

pin moving means structurally associated with the pin and mounted to the front end of the frame structure for pivotable movement about an axis perpendicular to the longitudinal axis of the pin to move the pin between the lower chain engaged position and the raised chain disengaged position; and, a pin stabilizing plate separate from the pin moving means, pivotally attached to the frame structure and having an elongated slot formed therein receiving the pin therethrough, the elongated slot having a width dimension slightly larger than the diameter of the pin for caging the pin against horizontal movement as the pin moves vertically and for movement with the pin as the pin moves along the longitudinal axis of the pin cooperating therewith to assist in the alignment of said pin in an engaged position with said conveyor chain.

3. The load carrying unit of claim 1, wherein the pin moving means comprises:

an angled plate having a first arm and a second arm disposed at an acute angle to each other;

pivot means associated with the angled plate defining a pivot axis perpendicular to the longitudinal axis of the pin about which the angled plate pivots;

the first arm of the plate depending from the pivot means at the front of the frame structure and the second arm of the plate extends back from the pivot means to the location of the pins; and, means attaching the pin to the second arm of the plate such that the pin is moved by the plate as the plate pivots about the pivot axis of the pivot means.

4. The load carrying unit of claim 1, further comprising:

a sleeve attached near the front end of the frame structure; and, the pin is received in the sleeve for movement in the sleeve between the lowered chain engaged position and the raised chain disengaged position.

5. The load carrying unit of claim 1, further comprising an anti-backup device associated with at least one of the floor engaging wheels to prevent the load carrying unit from moving in a direction opposite to the direction of movement of the conveyor chain when the conveyor chain engagement pin is in the raised chain disengaged position.

6. The load carrying unit of claim 5, wherein the anti-backup device comprises an arm pivotably mounted at one end and having its distal end in contact with the periphery of the cart ground engaging wheel.

7. The load carrying unit of claim 1, further comprising a pin actuating device at the rear end of the frame structure for coacting with the pin moving means at the front end of a following one of the load bearing units moving along the conveyor path to move the pin of the following one of the load bearing units to the raised chain disengaged position.

8. The load carrying unit of claim 1, wherein the depending end of the pin is tapered.

9. The load carrying unit of claim 8, wherein the taper of the depending end of the pin is between about 3 and about 15 degrees.

10. A conveyor system for moving load carrying units along a predetermined conveying path comprising:

(a) an endless conveyor chain defining the conveying path to be traveled by the load carrying units;

(b) means for linearly moving the conveyor chain along the defined path;

(c) the load carrying unit comprising:

a frame structure;

floor engagement wheels rotatably attached to the frame structure;

a depending movable conveyor chain engagement pin attached to the frame structure near the front end of the frame structure movable between a lowered chain engaged position whereat the depending end of the pin engages the conveyor chain and a raised chain disengaged position whereat the depending end of the pin is spaced above and out of contact with the conveyor chain;

pin moving means structurally associated with the pin and mounted to the front end of the frame structure for pivotable movement about an axis perpendicular to the longitudinal axis of the pin; and, (d) activator means for selectively actuating the pin from the conveyor chain engaged position to the conveyor chain disengaged position, the actuator means being located at preselected locations along the conveyor path and disposed adjacent to the endless conveyor chain, the actuator means selectively coacts with the pin moving means to cause the pin moving means to pivot moving the pin to the chain disengaged position as the load carrying unit approaches the actuator means, the actuator means comprising a movable arm movable between a raised position whereat it coacts with the pin moving means and a lowered position whereat it does not coact with the pin moving means as the load carrying unit passes the actuator means.

11. A conveyor system for moving load carrying units along a predetermined conveying path comprising:

a pair of walls spaced apart to either side of the endless conveyor chain defining a narrow open top load carrying unit guide channel along which the conveyor chain travels, the load carrying unit guide channel walls terminating above the elevation of the conveyor chain;

a depending sleeve attached to each of the load carrying units extending into the load carrying unit guide channel through the open top thereof and terminating a distance above the conveyor chain traveling in the guide channel, the diameter of the sleeve being slightly less than the width of the guide channel to provide a clearance between the sleeve and the walls of the guide channel;

a conveyor chain engaging pin slidably received in the sleeve of the load carrying units for selective engagement with the conveyor chain connecting the load carrying unit to the conveyor chain for movement with the conveyor chain along the conveying path; and, pin moving means for selectively moving the chain engaging pin in the sleeve between a lowered conveyor chain engaged position in which position the load carrying units are connected to the conveyor chain for movement therewith and a raised conveyor chain disengaged position in which disengaged position the load carrying units are disconnected from the conveyor chain such that the load carrying units remain stationary as the conveyor chain continues to move whereby the sleeve coacts with the walls of the guide channel to maintain the raised conveyor chain engaging pin in alignment with the conveyor chain such that when the conveyor chain engaging pin is lowered to the conveyor chain engaged position the conveyor chain engaging pin will properly engage the conveyor chain.

* * * * *